US008979337B2

(12) United States Patent
Creusen

(10) Patent No.: US 8,979,337 B2
(45) Date of Patent: Mar. 17, 2015

(54) LIGHTING MODULE

(75) Inventor: Martinus Petrus Creusen, Wijlre (NL)

(73) Assignee: Koninklijke Philips N.V., Eindhoven (NL)

( * ) Notice: Subject to any disclaimer, the term of this patent is extended or adjusted under 35 U.S.C. 154(b) by 153 days.

(21) Appl. No.: 13/695,800

(22) PCT Filed: Apr. 27, 2011

(86) PCT No.: PCT/IB2011/051827

§ 371 (c)(1),
(2), (4) Date: Nov. 2, 2012

(87) PCT Pub. No.: WO2011/141846

PCT Pub. Date: Nov. 17, 2011

(65) Prior Publication Data

US 2013/0051015 A1 Feb. 28, 2013

(30) Foreign Application Priority Data

May 11, 2010 (EP) ..... 10162493

(51) Int. Cl.

| | |
|---|---|
| ***F21V 7/04*** | (2006.01) |
| ***F21V 29/00*** | (2006.01) |
| ***F21K 99/00*** | (2010.01) |
| ***F21V 23/00*** | (2006.01) |
| ***F21V 19/00*** | (2006.01) |
| *F21Y 101/02* | (2006.01) |

(52) U.S. Cl.

CPC ..... *F21V 29/004* (2013.01); *F21K 9/00* (2013.01); *F21V 23/006* (2013.01); *F21V 19/003* (2013.01); *F21V 29/002* (2013.01); *F21V 29/2206* (2013.01); *F21V 29/2256* (2013.01); *F21V 29/2225* (2013.01); *F21Y 2101/02* (2013.01); *F21V 19/0035* (2013.01); *F21V 29/2218* (2013.01)

USPC ..... 362/549; 362/545; 362/265

(58) Field of Classification Search

USPC ..... 362/549, 545, 265

See application file for complete search history.

(56) References Cited

U.S. PATENT DOCUMENTS

| | | | | |
|---|---|---|---|---|
| 6,161,910 | A | 12/2000 | Reisenauer et al. | |
| 2008/0025028 | A1 | 1/2008 | Gloisten et al. | |
| 2008/0123341 | A1 | 5/2008 | Chiu | |
| 2008/0253127 | A1 * | 10/2008 | Willwohl et al. | 362/294 |
| 2009/0218923 | A1 | 9/2009 | Gingrich, III et al. | |

FOREIGN PATENT DOCUMENTS

| | | | |
|---|---|---|---|
| CN | 201434267 | Y | 3/2010 |
| DE | 102007044628 | A1 | 4/2009 |
| EP | 2077415 | A1 | 7/2009 |
| WO | 2007034361 | A1 | 3/2007 |
| WO | 2009036198 | A2 | 3/2009 |
| WO | 2010146509 | A1 | 12/2010 |

* cited by examiner

*Primary Examiner* — Vip Patel
(74) *Attorney, Agent, or Firm* — Yuliya Mathis

(57) ABSTRACT

A lighting module (1) comprising at least one light emitting device (3) arranged on a first carrier (10); driving electronics (4) for driving the at least one light emitting device (3) arranged on a second carrier (11); and an optical interface (5) for outputting light emitted by the at least one light emitting device (3), wherein the second carrier (11) is arranged in a plane substantially parallel to the first carrier (10), wherein the first (10) and second (11) carriers are configured such that a projection of the first carrier (10) onto the plane is substantially non-overlapping with the second carrier (11) so as to form a non-overlapping region, wherein the driving electronics is at least partially arranged in the non-overlapping region. The inventive lighting module enables more efficient use of the space in the lighting module.

11 Claims, 4 Drawing Sheets

LIGHTING MODULE

FIELD OF THE INVENTION

The present invention relates to a lighting module comprising at least one light emitting device and driving electronics for driving said at least one light emitting device.

BACKGROUND OF THE INVENTION

In applications with light emitting diodes (LEDs) it is desirable, from ease of installation and cost-effectiveness, to combine the electronic driving circuit and the LEDs in a single lighting module. An example of such a lighting module is previously known from U.S. Pat. No. 6,161,910, disclosing an LED reading light assembly that includes an optical assembly, a power circuit board, and a housing. The optical assembly includes a holographic lens and an LED assembly comprising an LED circuit board and a plurality of LEDs disposed on the outward facing side of the LED circuit board. The housing includes a housing plate and a black anodized fin plate. The LED reading light assembly is designed such that the LED circuit board and the power circuit board are parallel, with the power circuit board located beneath the LED circuit board, and the housing plate disposed between the LED circuit board and the power circuit board. In operation, heat generated by the LEDs is transferred radially outward by the housing plate and then rearward to the black anodized fin plate.

Although U.S. Pat. No. 6,161,910 manage to combine the electronic driving circuit and the LEDs in a single lighting module, it would be desirable to enable a more compact lighting module and a lower overall thermal resistance between LEDs and the heatsink.

SUMMARY OF THE INVENTION

It is an object of the present invention to overcome this problem, and to provide a more compact lighting module and a thermally optimized heat path for both the at least one light emitting device and the driving electronics.

According to an aspect of the invention, this and other objects are achieved by a lighting module comprising: at least one light emitting device arranged on a first carrier; driving electronics for driving the at least one light emitting device arranged on a second carrier; and an optical interface for outputting light emitted by the at least one light emitting device, wherein the second carrier is arranged in a plane substantially parallel to the first carrier, which plane is displaced from the first carrier in a direction away from the optical interface, wherein the first and second carriers are configured such that a projection of the first carrier onto the plane is substantially non-overlapping with the second carrier so as to form a non-overlapping region, wherein the driving electronics is at least partially arranged in the non-overlapping region.

The present invention is based on the understanding that by at least partially arranging the driving electronics in a non-overlapping region, the space in the lighting module can be used more efficiently. In particular, the distance between the first carrier and the plane in which the second carrier is arranged may be reduced, since the driving electronics arranged in the non-overlapping region does not have to be fitted beneath the first carrier, but may extend next to it. Furthermore, the thermal resistance of the light emitting devices can be reduced compared to the prior art solution with overlapping carriers due to a shorter thermal path between the light emitting device(s) and the heat sink. Besides the heat generated by the driving electronics is not dissipated using the same carrier as the light emitting devices. At the same time, unlike an arrangement where the light emitting device(s) and the driving electronics are arranged on the same carrier, the carrier with the driving electronics may here be displaced from the optical interface just enough to avoid that the driving electronics interfere with the design of the optical interface.

The lighting module may further comprise a heat conducting element that has a first side having a surface with a protrusion, wherein the first carrier is arranged on top of the protrusion, and the second carrier is arranged on a portion of the surface that surrounds the protrusion. As the interface between the first carrier and the heat conducting element, and the interface between the second carrier and the heat conducting element are displaced from one another, the light emitting device(s) will not heat up the driving electronics to the extent that would otherwise occur, thereby increasing the lifetime of electrical components such as the capacitors and diodes. Similarly, the driving electronics will not heat up the light emitting device(s) to the extent that would otherwise occur, thereby reducing the temperature of the light emitting device(s).

A second side of the heat conducting element, preferably located opposite the first side of the heat conducting element, may define a thermal interface for thermally connecting the heat conducting element to a heat sink. The thermal interface may preferably be essentially flat to provide an interface that can be easily connected to the heat sink. The heat sink may be integrated in the lighting module, or may be an external heat sink to which the lighting module can be connected. According to an alternative embodiment, the heat conducting element itself may be a heat sink.

The optical interface may include a reflecting structure arranged to reflect light emitted by the at least one light emitting device, which reflecting structure may have an opening enclosing an area of the first carrier where the at least one light emitting device is arranged. Furthermore, the second carrier may be arranged outside the reflecting structure. Thus, the driving electronics arranged on the second carrier may extend into any space available between reflecting structure and a housing of the lighting module, thereby enabling an efficient use of the space available in the lighting module.

The first carrier may preferably be a first printed circuit board (PCB) and the second carrier may preferably be a second printed circuit board. Further, the at least one light emitting device may be a light emitting diode (LED). The light emitting diode may be mounted to the first printed circuit board by means of surface mount technology. An advantage with using surface mounted technology instead of through-hole technology is that it lends itself to PCB-technologies that allow better thermal transfer.

The first printed circuit board may be configured to electrically isolate the at least one light emitting device from the heat conducting element, while thermally connecting the at least one light emitting device to the heat conducting element. This can be achieved e.g. by using a ceramic PCB, a metal-core PCB or a PCB with thermal vias.

The driving electronics may be at least partly mounted to the second printed circuit board by means of through-hole technology. Furthermore, an electrically insulating but thermally conductive layer may be arranged between the second carrier and said heat conducting element.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

DETAILED DESCRIPTION

A preferred embodiment of the present invention will now be described with reference to FIGS. 1 and 2.

Figure 1:
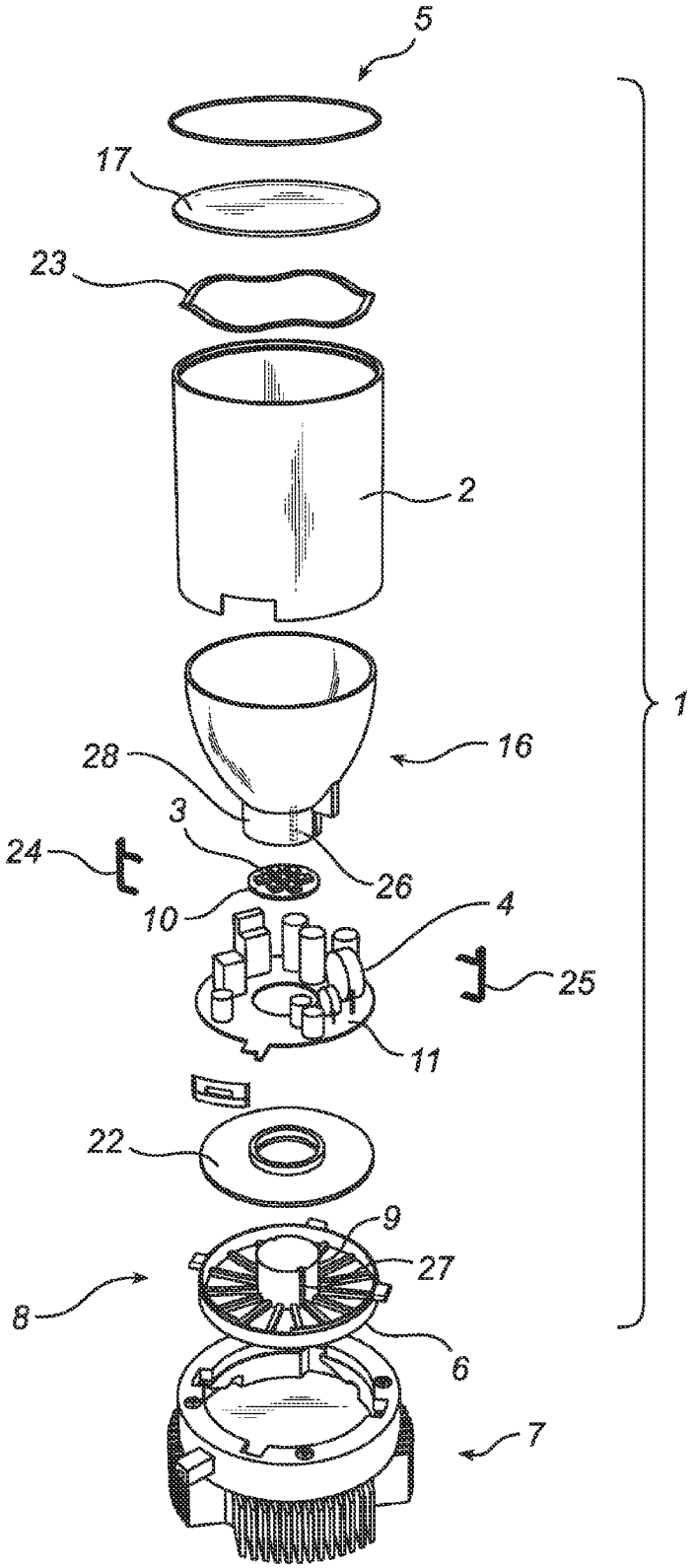
FIG. 1 is an exploded perspective view schematically illustrating a lighting module according to an embodiment of the invention.
Figure 2:
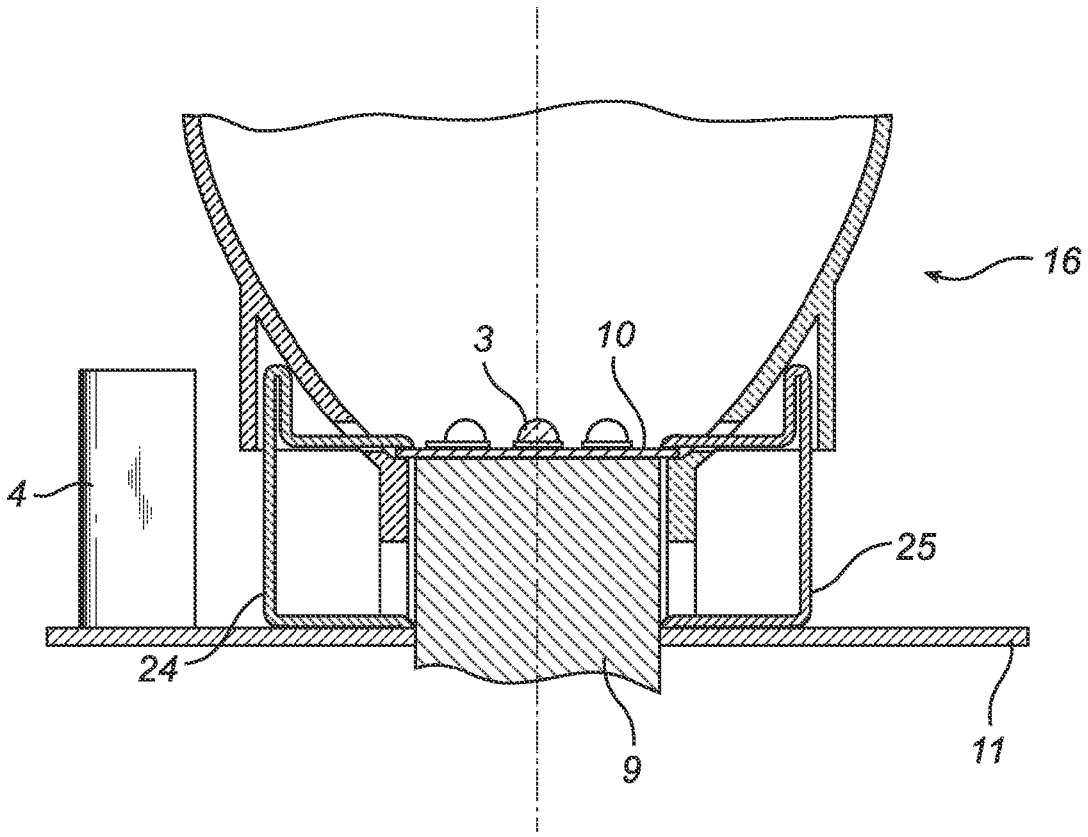
FIG. 2 shows a cross-section of the lighting module in FIG. 1.

In the embodiment illustrated in FIG. 1, the lighting module 1 has a cylindrical housing 2 that accommodates a plurality of light emitting devices 3, driving electronics 4 for driving the light emitting devices, an optical interface 5 for outputting light that is emitted by the light emitting devices 3, and a thermal interface 6 for connecting the light emitting devices 3 and the driving electronics 4 to an external heat sink 7. The lighting module 1 can be connected to the external heat sink in a variety of ways well-known in the art. For example, the lighting module can be releasably connected to the heat sink by means of the connector described in European Patent Application 09167919.1, published as WO 2010/146509, which is hereby incorporated by reference.

The thermal interface of the lighting module is here defined by of a bottom surface 6 of a heat conducting element 8. The heat conducting element is preferably a heat spreader in the form of a cylindrical aluminium plate with a concentric cylindrical protrusion 9. However, as is recognized by a person skilled in the art, the shape of the heat conducting element and its protrusion may vary. Furthermore, other materials having a high thermal conductivity such as copper, carbon, thermally conductive plastic or ceramics may be also used. The heat spreader 8 is here firmly mounted to the housing 2.

The light emitting devices 3 are preferably light emitting diodes (LEDs) arranged on a first carrier 10 mounted on top of the protrusion 9 of the heat spreader. The shape of the first carrier preferably corresponds to the shape of the top surface of the protrusion, and is here circular. Furthermore, the first carrier preferably has an area being about the same size or slightly larger than the area of the top surface of the protrusion.

The driving electronics 4 are arranged on a second, preferably ring-shaped, carrier 11 placed around the cylindrical protrusion 9 so that the bottom surface of the second carrier 11 is in thermal contact with a surface 13 of the heat spreader that surrounds the protrusion 9. As a result, the second carrier 11 is arranged in a plane substantially parallel to the first carrier 10, but the plane is displaced from the first carrier 10 in a direction away from the optical interface 5. The word substantially parallel should be interpreted such that the angle between the plane in which the second carrier 11 is arranged and the first carrier 10 is smaller that 20 degrees. The displacement is here determined by the height of the protrusion 9, and may preferably be selected such that the electronic components of driving electronics do not interfere with the design of the optical interface. The driving electronics may be powered by an internal power source, such as an integrated re-chargeable battery, e.g. Ni—Cd or Li-ion cell (not shown), and/or by an external power source or directly connected to mains. The lighting module may include all of the circuitry of the driving electronics. However, as is recognized by a person skilled in the art, it is also possible to arrange part of the circuitry of the driving electronics in the lighting module and provide part of the circuitry of the driving electronics externally.

The first 10 and second carriers 11 are preferably printed circuit boards (PCBs). The driving electronics is typically mounted to the PCB by means of through-hole technology. To electrically isolate the driving electronics 4 from the heat spreader 8, a layer 22 of electrically isolating but thermally conducting material (e.g. a sheet of poly carbonate material or thermal gap pad material) is arranged between the second carrier 11 and the heat spreader 8. The LEDs 3 are preferably mounted to the PCB by surface mount technology. As the LEDs are not limited by the through-hole requirement, a thermally optimized PCB technology can be selected for the LEDs. Here a ceramic PCB is used as this offers a low thermal resistance between LEDs 3 and thermal heat spreader 8. Another advantage of using a ceramic PCB for the LEDs is the reduced risk of solder fatigue, especially for LED solder temperatures higher than 85 degrees Celsius. This is because the ceramic PCB has no mismatch in thermal expansion with the ceramic submount on which the LEDs are placed. However, other PCB technologies may also be utilized, such as a Cu-based IMS carrier that offers a very low thermal resistance between LEDs and thermal heat spreader. Still further examples of PCB technologies are FR4, and MCPCB. An alternative to using a PCB is to solder a single multi-die package, directly on the top of the protrusion of the heat spreader, optionally with an additional electrical isolation layer (e.g. Kapton) arranged between the multi-die package and the heat spreader. Yet another alternative is to mount the LEDs directly onto the heat spreader, without a separate carrier, to further improve the thermal contact between LED and thermal heatspreader. In this case the heat spreader itself serves as a carrier, and may be electrically isolated from the LEDs by oxidizing the surface of the heat spreader.

In the illustrated embodiment, the optical interface 5 includes a reflecting structure 16 for reflecting light emitted by the LEDs 3, and an optical glass plate 17 that allows light to escape. The reflecting structure 16, which is here a (parabolic) reflector 16 with a reflective surface, has a light input end adjacent the first carrier 10, and a light output end adjacent the glass plate 17. The light input end of the reflector has a circular opening arranged such that the opening encloses a portion of the first carrier 10 where the LEDs 3 are arranged. The reflector further includes a ring-shaped extension 28 arranged around the protrusion, and extending from the first carrier 10 to the heat spreader 8. The ring-shaped extension 28 may preferably have an axially extending rib 26 protruding from its inner surface, which rib 26 is received in a corresponding recess (or groove) 27 in the protrusion to prevent relative rotation between the reflector 16 and the heat spreader 8. Furthermore, electrical connectors 24, 25 are attached to the ring-shaped extension 28 of the reflector to provide electrical contact between the first 10 and second 11 carriers. By firmly mounting the optical glass 17 plate to the housing 2 and arranging a wave ring 23 (or sinus spring) between the optical glass 17 and the reflector 16, the reflector is pressed downwards (i.e. in a direction towards the thermal interface 6) such that portions of the electrical connectors 24,25 that extends above the carriers 10, 11 are pressed against the first 10 and second 11 carriers, thereby providing a reliable electrical contact between the driving electronics 4 and the LEDs 3. Moreover, the first 10 and second 11 carriers will be pressed against the heat spreader 8 to ensure good thermal contact between the carriers 10, 11 and the heat spreader 8.

In operation heat generated by the LEDs 3 and heat generated by the driving electronics 4 are transferred to the heat spreader 8 and then dissipated via the heat sink 7. However, as the driving electronics are here arranged lower than the LEDs, the LEDs will not heat up the driving electronics, and the driving electronics will not heat up the LEDs. Thus, the temperature of the electronic components can be reduced substantially. At the same time, the penalty of increasing the thermal resistance from LEDs 3 to the heat sink 7 is relatively small. For example, in case the difference in height is 10 mm, the additional thermal resistance is typically 5-10 W/K resulting in an additional temperature increase of max. 3° C. for a 15 W LED application.

Figure 3:
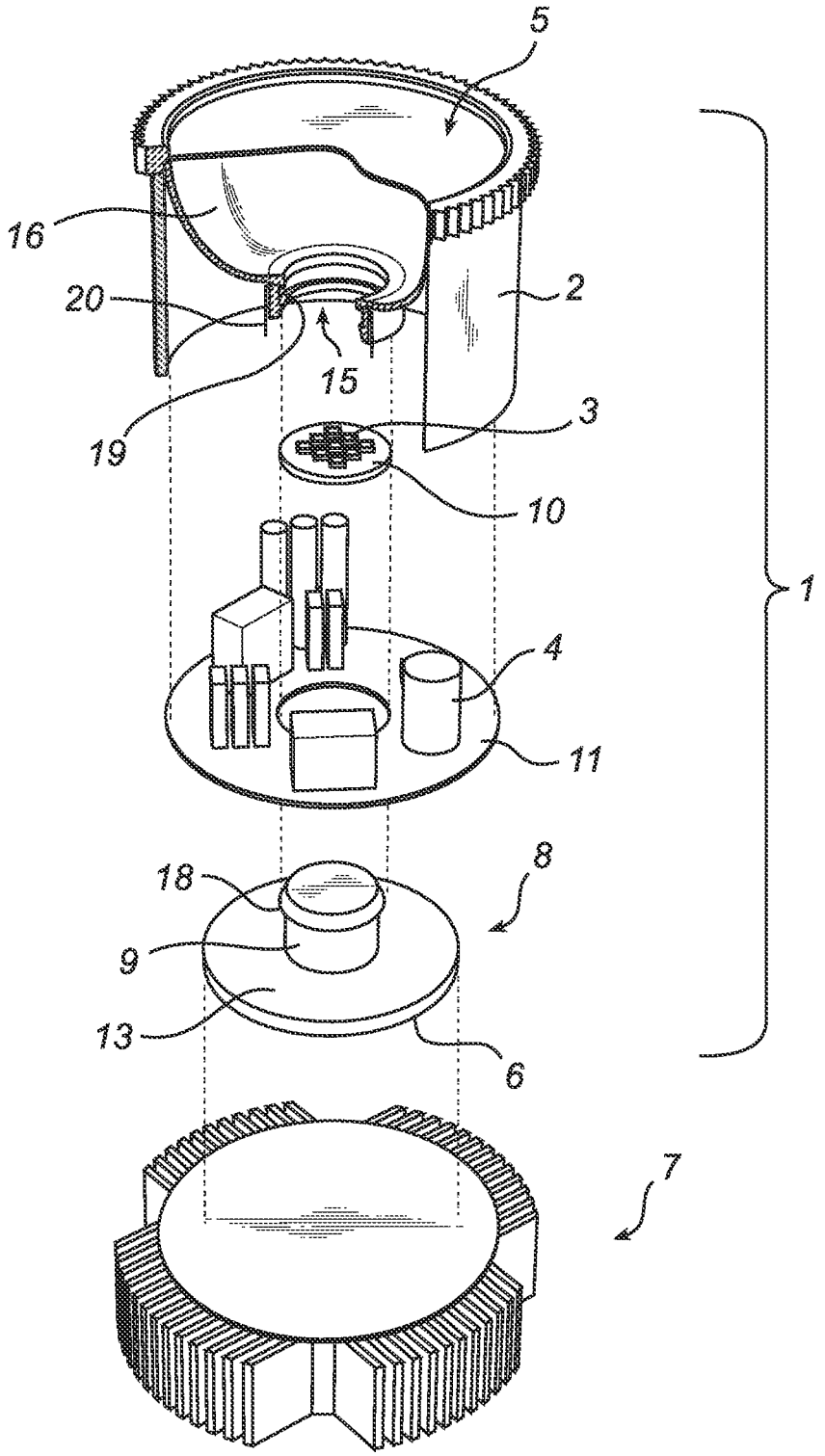
FIG. 3 is an exploded perspective view schematically illustrating a lighting module according to an alternative embodiment of the invention.
Figure 4:
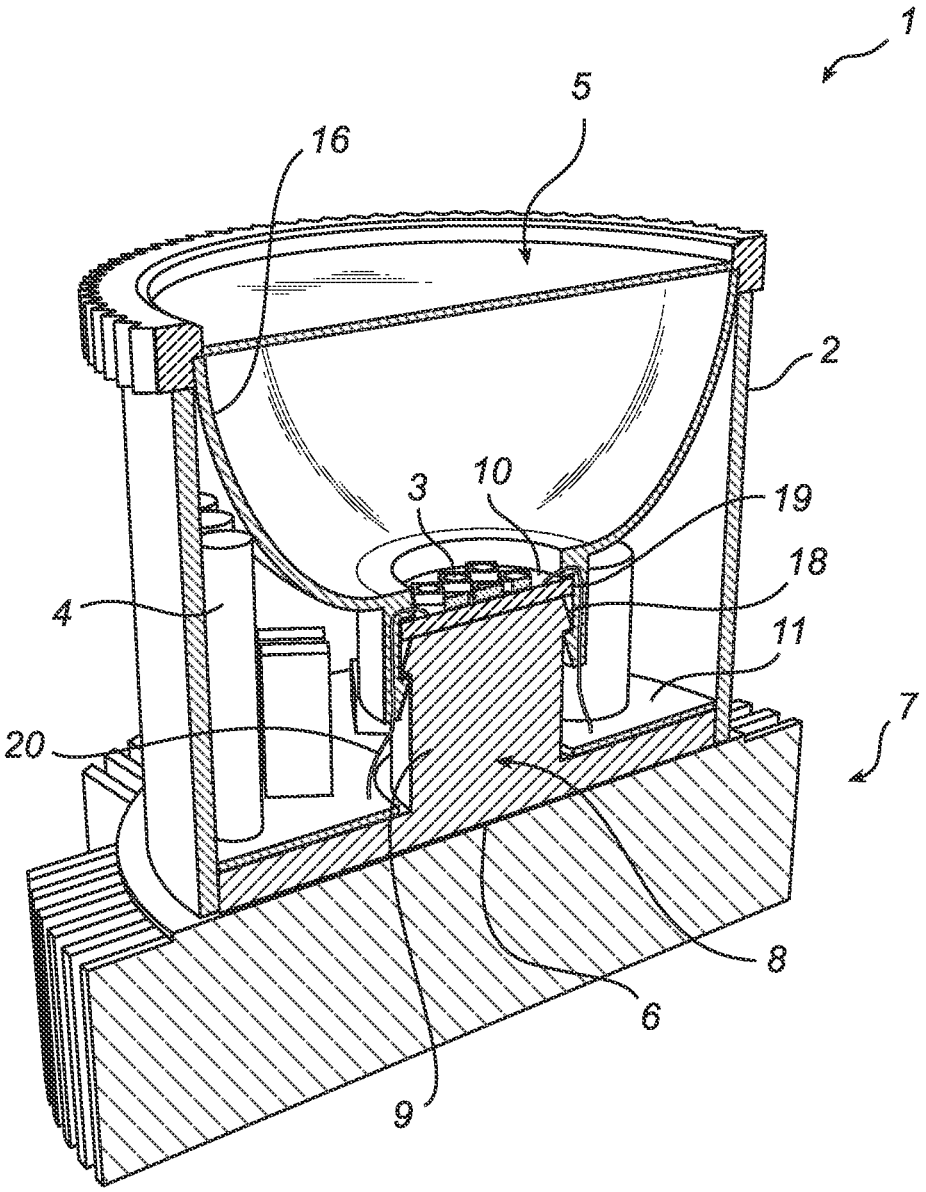
FIG. 4 shows a cross-section of the lighting module in FIG. 3.

FIGS. 3 and 4 illustrate an alternative embodiment of the invention. Here, the heat spreader 8 is provided with a collar 18 at the top of the protrusion 9, and the reflecting structure 16 has a receiving structure 19 arranged at the opening 15 of the reflector. The receiving structure 19, which encloses the opening, has a recess adapted to receive the collar 18 of the protrusion and a peripheral portion of the first carrier 10. The receiving structure is configured such that, when the collar 18 and the peripheral portion of the first carrier 10 is arranged in the recess of the receiving structure, the heat conducting element 8 is fastened to the reflector with the first carrier firmly held on top of the protrusion. Furthermore, the collar 18 and/or the receiving structure 19 may preferably be chamfered such that the lighting module can be assembled by pressing the protrusion 19 of heat spreader into the receiving structure 19 until the collar 18 snaps into place inside the recess in the receiving structure 19. Moreover, the electrical connectors 20 that electrically connect the LEDs 3 to the driving electronics 4 are preferably integrated in the reflector 16 and configured to press the first carrier 10 against the heat spreader 8 to promote a good thermal contact between the LEDs 3 and the heat spreader 8.

The person skilled in the art realizes that the present invention by no means is limited to the preferred embodiments described above. On the contrary, many modifications and variations are possible within the scope of the appended claims. For example, although the reflecting structure is here illustrated as a parabolic reflector, the reflecting structures may take other forms and may e.g. be a mixing chamber. Furthermore, instead of the described reflecting structure, the optical interface may include a reflector that utilizes Total Internal Reflection (TIR). Other types of beam shaping optics may also be used such as a collimator in combination with a (Fresnel) lens on the exit window. Furthermore, instead of using an external heat sink, an integrated heat sink may be used. Moreover, the carriers may be mounted directly on to a heat sink integrated in the lighting module, without using a heat spreader.

The invention claimed is:

1. A lighting module comprising:

at least one light emitting device arranged on a first carrier;

driving electronics for driving said at least one light emitting device arranged on a second carrier; and an optical interface for outputting light emitted by said at least one light emitting device, wherein said second carrier is arranged in a plane substantially parallel to said first carrier, wherein said first and second carriers are configured such that a projection of said first carrier onto said plane is substantially non-overlapping with the second carrier so as to form a non-overlapping region, wherein said driving electronics is at least partially arranged in said non-overlapping region, further comprising a heat conducting element that has a first side having a surface with a protrusion, wherein the first carrier is arranged on top of the protrusion, and the second carrier is arranged on a portion of the surface that surrounds the protrusion, wherein a second side of the heat conducting element defines a thermal interface for thermally connecting said first and second carriers to a heat sink.

2. A lighting module according to claim 1, wherein the plane in which the second carrier is arranged is displaced from said first carrier in a direction away from the optical interface.

3. A lighting module according to claim 1, wherein the optical interface includes a reflecting structure arranged to reflect light emitted by said at least one light emitting device, said reflecting structure having an opening enclosing an area of the first carrier where the at least one light emitting device is arranged.

4. A lighting module according to claim 3, wherein said second carrier is arranged outside the reflecting structure.

5. A lighting module according to claim 3, wherein at least one of said first and second carriers is a printed circuit board.

6. A lighting module according to claim 5, wherein said at least one light emitting device is a light emitting diode (LED).

7. A lighting module according to claim 6, wherein said light emitting diode is mounted to the printed circuit board by means of surface mount technology.

8. A lighting module according to claim 5, wherein said printed circuit board is configured to electrically isolate the at least one light emitting device from the heat conducting element, while thermally connecting the at least one light emitting device to the heat conducting element.

9. A lighting module according to claim 5, wherein said driving electronics is at least partly mounted to the printed circuit board by means of through-hole technology.

10. A lighting module according to claim 9, wherein an electrically insulating but thermally conductive layer is arranged between said second carrier and said heat conducting element.

11. A lighting module comprising:

at least one light emitting device arranged on a first carrier;

driving electronics for driving said at least one light emitting device arranged on a second carrier; and an optical interface for outputting light emitted by said at least one light emitting device, wherein said second carrier is arranged in a plane substantially parallel to said first carrier, wherein said first and second carriers are configured such that a projection of said first carrier onto said plane is substantially non-overlapping with the second carrier so as to form a non-overlapping region, wherein said driving electronics is at least partially arranged in said non-overlapping region, further comprising a heat conducting element that has a first side having a surface with a protrusion, wherein the first carrier is arranged on top of the protrusion, and the second carrier is arranged on a portion of the surface that surrounds the protrusion, wherein the optical interface includes a reflecting structure arranged to reflect light emitted by said at least one light emitting device, said reflecting structure having an opening enclosing an area of the first carrier where the at least one light emitting device is arranged.

* * * * *